US012133576B2

(12) United States Patent
Steinke, II

(10) Patent No.: US 12,133,576 B2
(45) Date of Patent: Nov. 5, 2024

(54) SNAP AND LOCK

(71) Applicant: Richard P. Steinke, II, Indio, CA (US)

(72) Inventor: Richard P. Steinke, II, Indio, CA (US)

( * ) Notice: Subject to any disclaimer, the term of this patent is extended or adjusted under 35 U.S.C. 154(b) by 0 days.

(21) Appl. No.: 18/456,706

(22) Filed: Aug. 28, 2023

(65) Prior Publication Data

US 2024/0057725 A1 Feb. 22, 2024

Related U.S. Application Data

(63) Continuation of application No. 16/019,393, filed on Jun. 26, 2018, now Pat. No. 11,832,690, which is a continuation-in-part of application No. 15/873,168, filed on Jan. 17, 2018, now Pat. No. 11,432,620.

(60) Provisional application No. 62/447,344, filed on Jan. 17, 2017.

(51) Int. Cl.

| | |
|---|---|
| ***A44B 1/32*** | (2006.01) |
| ***A44B 1/08*** | (2006.01) |
| ***A44B 1/34*** | (2006.01) |
| *A44B 17/00* | (2006.01) |

(52) U.S. Cl.

CPC ..... *A44B 1/32* (2013.01); *A44B 1/08* (2013.01); *A44B 1/34* (2013.01); *A44B 17/0076* (2013.01); *A44D 2200/10* (2013.01); *A44D 2201/50* (2013.01)

(58) Field of Classification Search

CPC .... A44B 1/32; A44B 1/08; A44B 1/34; A44B 17/0076; A44D 2200/10; A44D 2201/50

See application file for complete search history.

(56) References Cited

U.S. PATENT DOCUMENTS

| | | | | | |
|---|---|---|---|---|---|
| 2,723,433 | A | * | 11/1955 | Buren, Jr. | A44B 17/0005 411/969 |
| 3,045,309 | A | * | 7/1962 | Johnson, Sr. | A44B 17/0082 24/94 |
| 3,718,950 | A | * | 3/1973 | Engstrom | F16B 21/078 24/663 |
| 3,863,798 | A | * | 2/1975 | Kurihara | B65D 55/12 215/301 |
| 3,979,802 | A | * | 9/1976 | Bongartz | A44B 17/0082 24/107 |
| 4,137,607 | A | * | 2/1979 | Kramer | A44B 1/04 24/95 |
| 4,580,320 | A | * | 4/1986 | Takata | A44B 1/06 24/113 MP |
| 4,959,890 | A | * | 10/1990 | Pazurek | A44B 1/14 63/29.1 |
| 6,009,601 | A | * | 1/2000 | Kaufman | H01F 7/0263 24/49.1 |

(Continued)

*Primary Examiner* — David M Upchurch

(74) *Attorney, Agent, or Firm* — CP LAW GROUP PC; Cy Bates

(57) ABSTRACT

A button system containing two pieces that snap and lock together to fasten multiple articles of clothing. The top piece is made of three distinct parts: a detachable ridged color-coded cover, a fastener that attaches said cover to a rotatable hinged plate, and a fastener that secures all three pieces of the top piece. The bottom piece is also made up of three distinct parts: a plate to receive the hinges from the top piece, a curved structure that connects the hinge/cavity plates to the article of clothing, and a rivet that attaches to the article of clothing and the snap and lock invention.

17 Claims, 15 Drawing Sheets

(56) References Cited

U.S. PATENT DOCUMENTS

| | | | | |
|---|---|---|---|---|
| 6,564,434 | B1 * | 5/2003 | Morita | A45C 13/1069 24/114.2 |
| 6,895,642 | B2 * | 5/2005 | Huang | F16M 13/022 248/205.5 |
| 7,856,697 | B2 * | 12/2010 | Quimod | A44B 1/14 24/114.9 |
| 8,830,663 | B2 | 9/2014 | Child et al. | |
| 9,307,806 | B1 * | 4/2016 | Dorman | A47G 25/92 |
| 10,315,549 | B2 * | 6/2019 | Fiedler | F16B 27/00 |
| 2002/0039493 | A1 * | 4/2002 | Tanaka | G03B 17/00 396/543 |
| 2005/0223527 | A1 * | 10/2005 | Raccosta | A44B 17/0088 24/90.1 |
| 2008/0060110 | A1 * | 3/2008 | Schmelzer | A42B 1/24 2/69 |
| 2011/0225781 | A1 * | 9/2011 | Cameron | A44B 1/04 29/525 |
| 2012/0079645 | A1 * | 4/2012 | Carlson | A44B 17/0047 2/265 |
| 2013/0318775 | A1 | 12/2013 | Peters | |
| 2014/0317822 | A1 * | 10/2014 | Friedman | A44B 17/0082 2/69 |
| 2015/0053060 | A1 * | 2/2015 | Coakley | F16C 19/54 83/745 |
| 2016/0000189 | A1 * | 1/2016 | Bolen | A44B 1/30 24/303 |
| 2016/0270487 | A1 * | 9/2016 | Chen | A44B 17/0076 |
| 2017/0210611 | A1 * | 7/2017 | Bingham | F16B 1/00 |
| 2017/0288338 | A1 * | 10/2017 | Komoto | H01R 13/26 |

* cited by examiner

SNAP AND LOCK

BACKGROUND

Field of the Invention

This invention relates to the field of buttons, specifically fasteners for articles of clothing.

Description of the Related Art

Traditional buttons have long been used to easily fasten multiple articles of clothing together. A negative trait of the ease of traditional buttons is the ease at which they become undone. The present invention sets forth a novel system to allow the user to rotate the fastening device into a locked position to secure multiple articles of clothing and prevent unwanted detachment of said articles of clothing. This invention is particularly useful in athletics, action sports, and extreme conditions.

SUMMARY

The snap and lock invention is similar to a traditional button designed for an article of clothing, generally two pieces that snap together to fasten multiple articles of clothing.

This invention comprises the traditional two pieces, however, each piece incorporates novel concepts. The top piece is made up of two parts: (1) a ridged cover that is used as both a pressure point to secure the invention, and a grip to rotate the invention in and out of the locked position, and a male fastener that attaches the rigged cover to the (2) plate with hinges that functions as the bottom of the top piece of the snap and lock. The hinged place contains a female fastener that secures the two pieces of the top portion. The bottom piece of the snap and lock invention is made up of three parts: (1) a plate to receive the hinges from the top piece, said plate either closed or open, with a cavity to allow the hinges to rotate approximately 37 degrees into a locked position, and with bumper guards to prevent the hinges from over rotation, (2) a curved structure that serves to connect the hinge/cavity plates and the article of clothing attachment, and (3) a rivet that attaches to the article of clothing and the snap and lock invention. The invention also includes a member device that holds the invention together and guides the installation or assembly.

BRIEF DESCRIPTION OF THE DRAWINGS

The foregoing and other features of the invention will become apparent from the following drawings and detailed description of the preferred embodiment of the invention.

DETAILED DESCRIPTION

Figure 1:
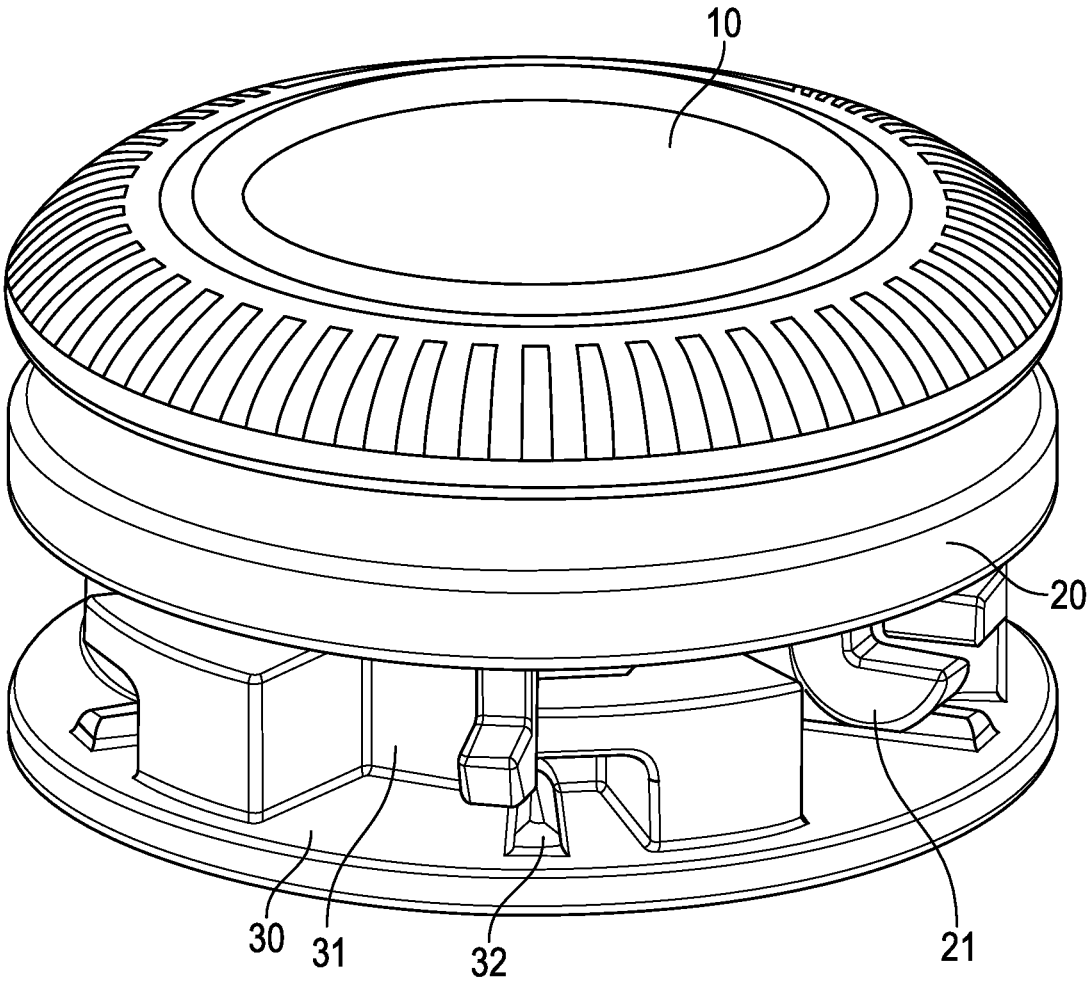
FIG. 1 is a front schematic view of the snap and lock button device open design.

FIG. 1 is a front schematic view of the invention in the preferred embodiment with the open design. The preferred embodiment is not intended to limit the scope of the invention. The preferred embodiment of the invention includes five parts: the ridged top plate 10 containing the star-shaped open clasp male fastener 11, the plate 20 containing the star-shaped open clasp female fastener 22 which connects to plate 10 and also contains hinges 21 on the reverse side of the female fastener, the plate 30 that receives the hinges 21 in cavities 31, a structure 40 that receives the plate 10 and plate 20 and allows the combined plates 10 and 20 to be rotated together into a fixed and secure position, and a rivet 50 that attaches the invention to an article of clothing.

Figure 2:
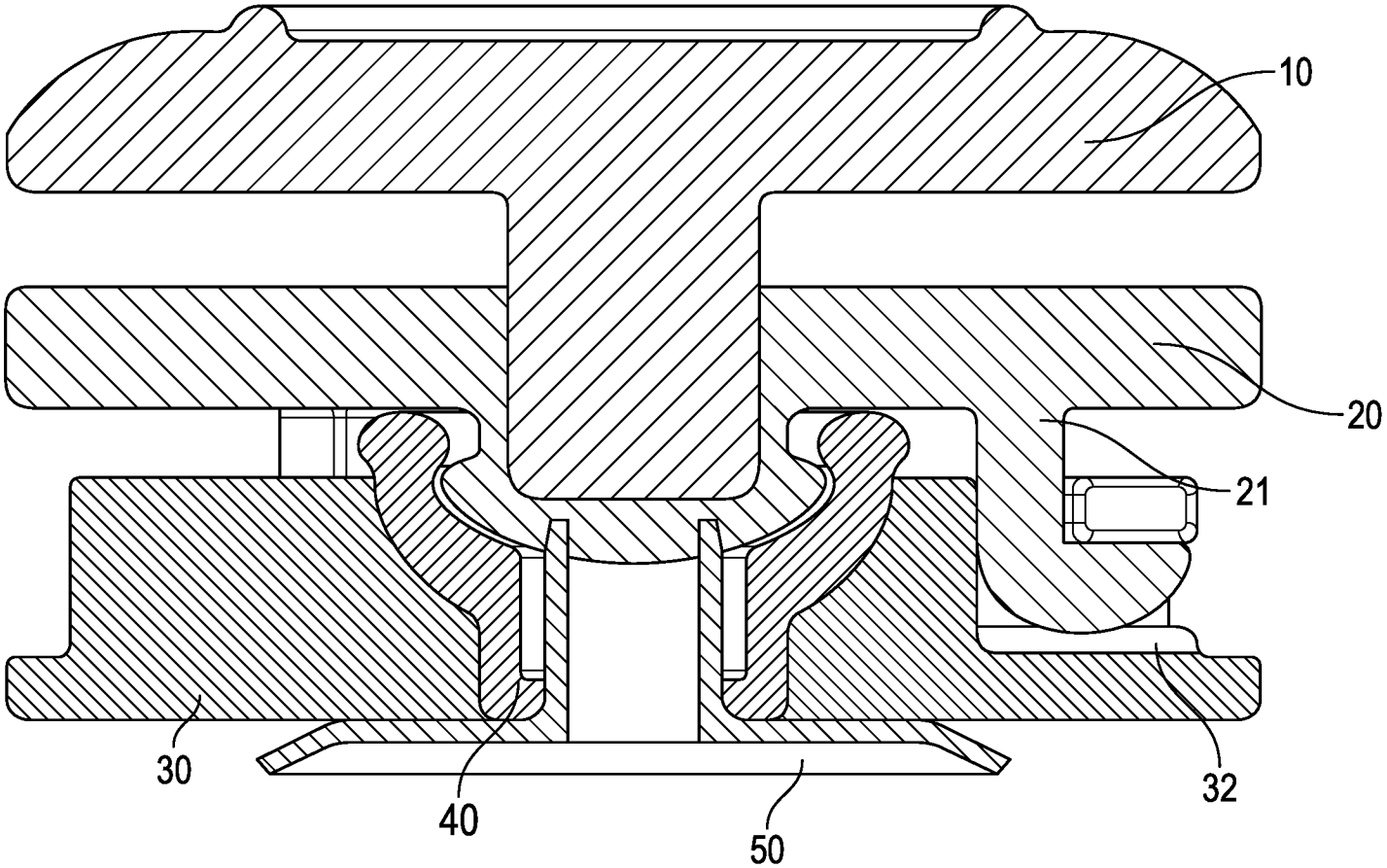
FIG. 2 is a cross-sectional view of the device shown in FIG. 1 taken from the center of the device.

FIG. 2 shows the cross-sectional view of the invention taken from the center of the invention. The ridged top plate 10 is shown attached to plate 20 with fastener 11 inserted to fastener 22 by snapping in place with applied downward force. Plate 20 with hinges 21 is locked in place with plate 30 with hinges 21 inside cavities 31 with said hinges inserted in said cavities and rotated approximately 37 degrees into a locked position. Bumper guides 32 guide hinges 21 into cavities 31 into a locked position keeping them from moving into the text cavity. Plate 20 is shown connected into structure 40 by snapping in place with applied downward force. Rivet 50 is shown detached from the invention and from an article of clothing.

Figure 3A:
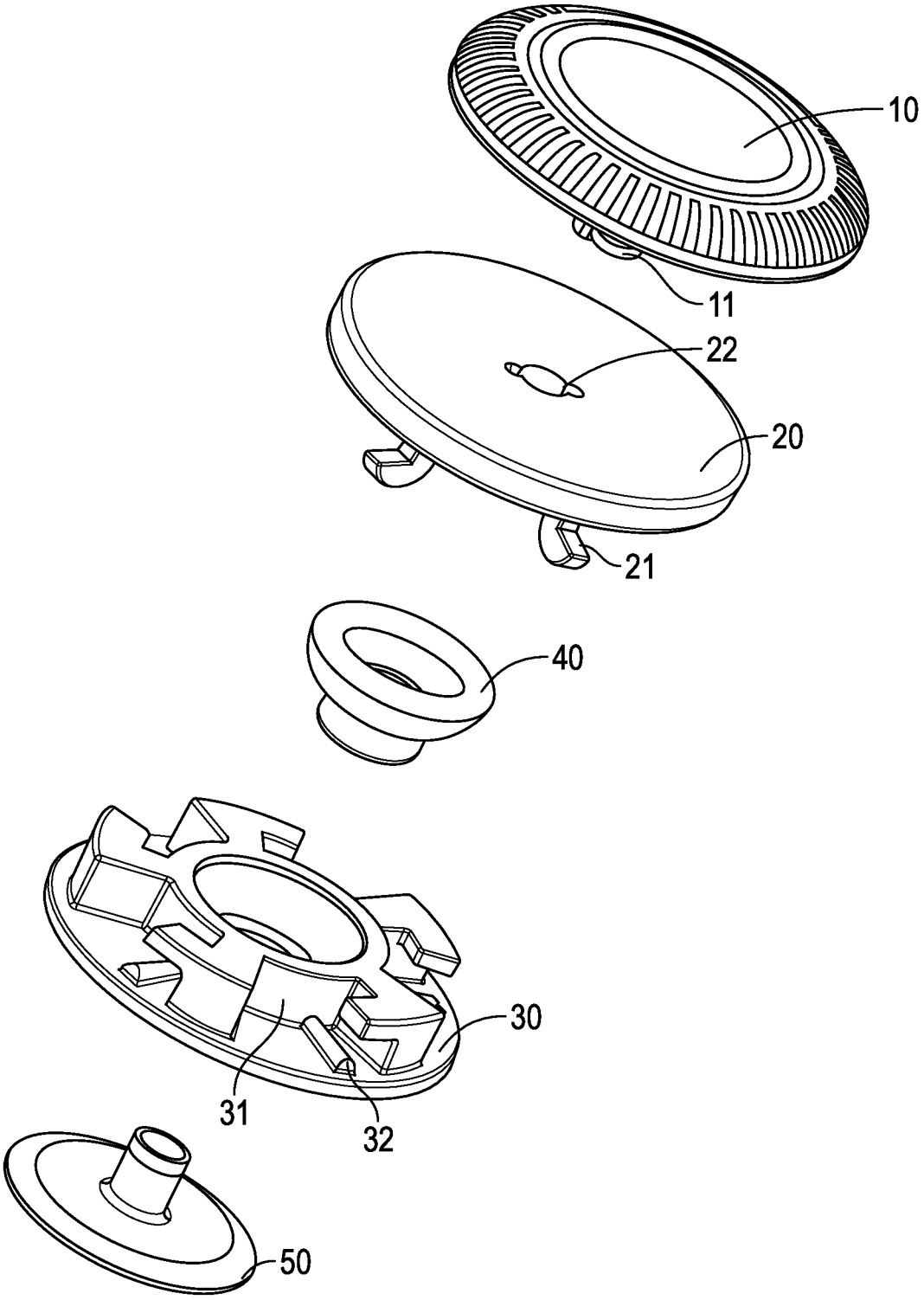
FIG. 3A is a semi-exploded angled view of the device shown in FIG. 1.

FIG. 3A is a semi-exploded view of the invention in the preferred embodiment. The ridged top plate 10 containing the star-shaped open clasp male fastener 11 is shown separated from plate 20. The plate 20 containing the star-shaped open clasp female fastener 22 and hinges 21 is shown detached from the plate 10 containing the male fastener. The plate 20 containing the female fastener and hinges 21 is shown detached from the plate 30 that receives the hinges 21 inside cavities 31 with bumper guides 32.

This FIG. 3A shows the open design for plate 30. Structure 40 that receives the united plate 10 and plate 20 is shown detached. Rivet 50 is shown detached from the invention and from an article of clothing.

Figure 3B:
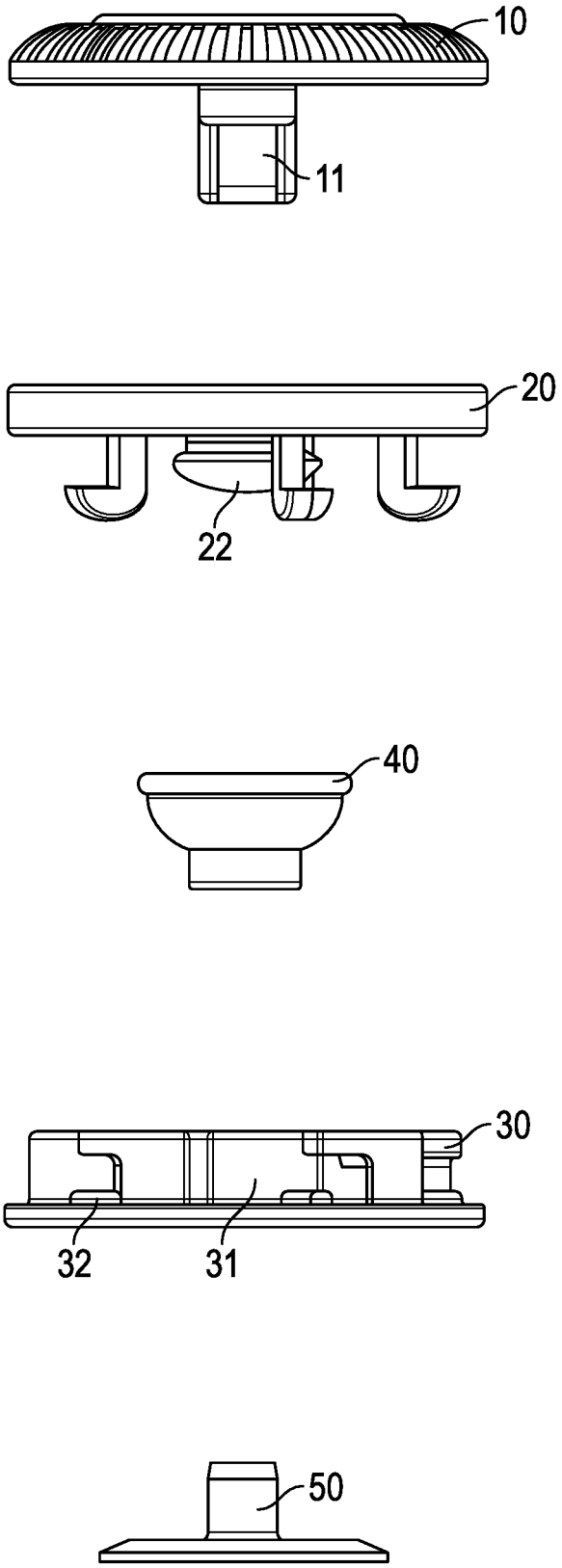
FIG. 3B is a semi-exploded front view of the device shown in FIG. 1.

FIG. 3B is a semi-exploded front view of the invention in the preferred embodiment and while incorporating the detailed description of FIG. 3A above, also shows fastener 11 and fastener 22.

Figure 3C:
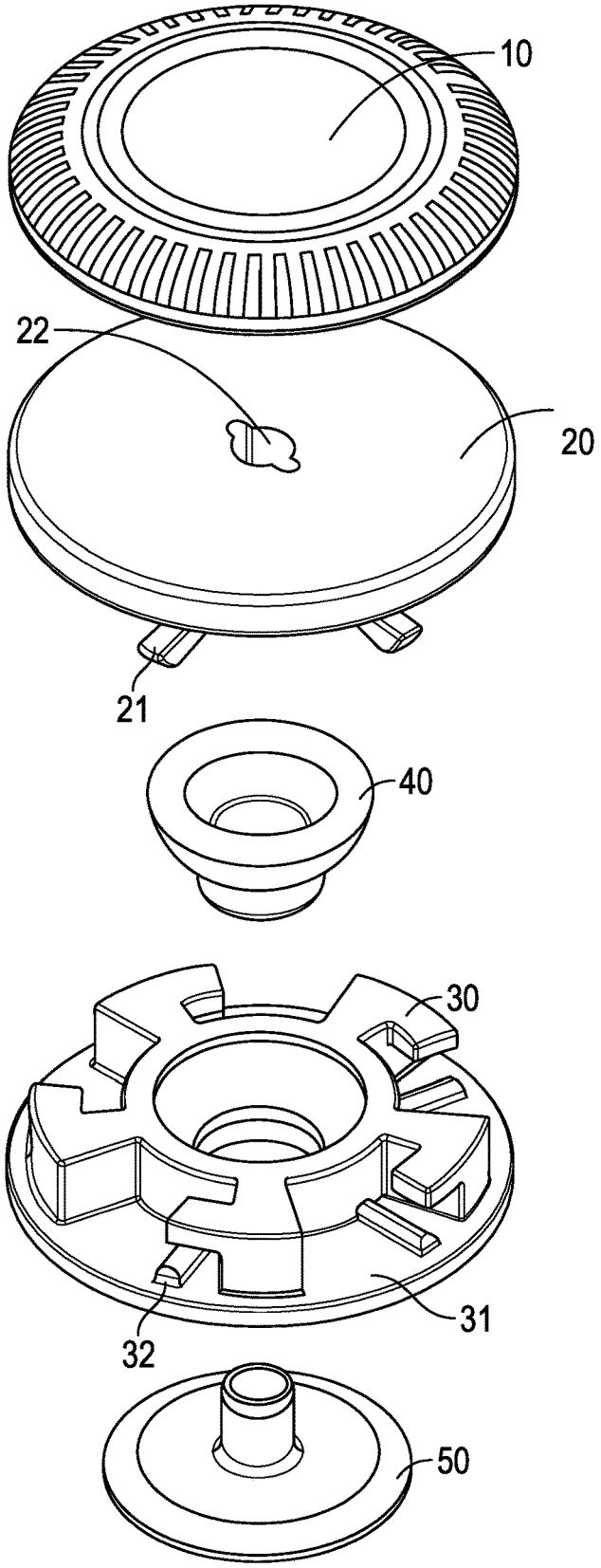
FIG. 3C is a semi-exploded front-angled view of the device shown in FIG. 1.

FIG. 3C is a semi-exploded front-angled view of the invention in the preferred embodiment and while incorporating the detailed description of FIG. 3A above.

Figure 4:
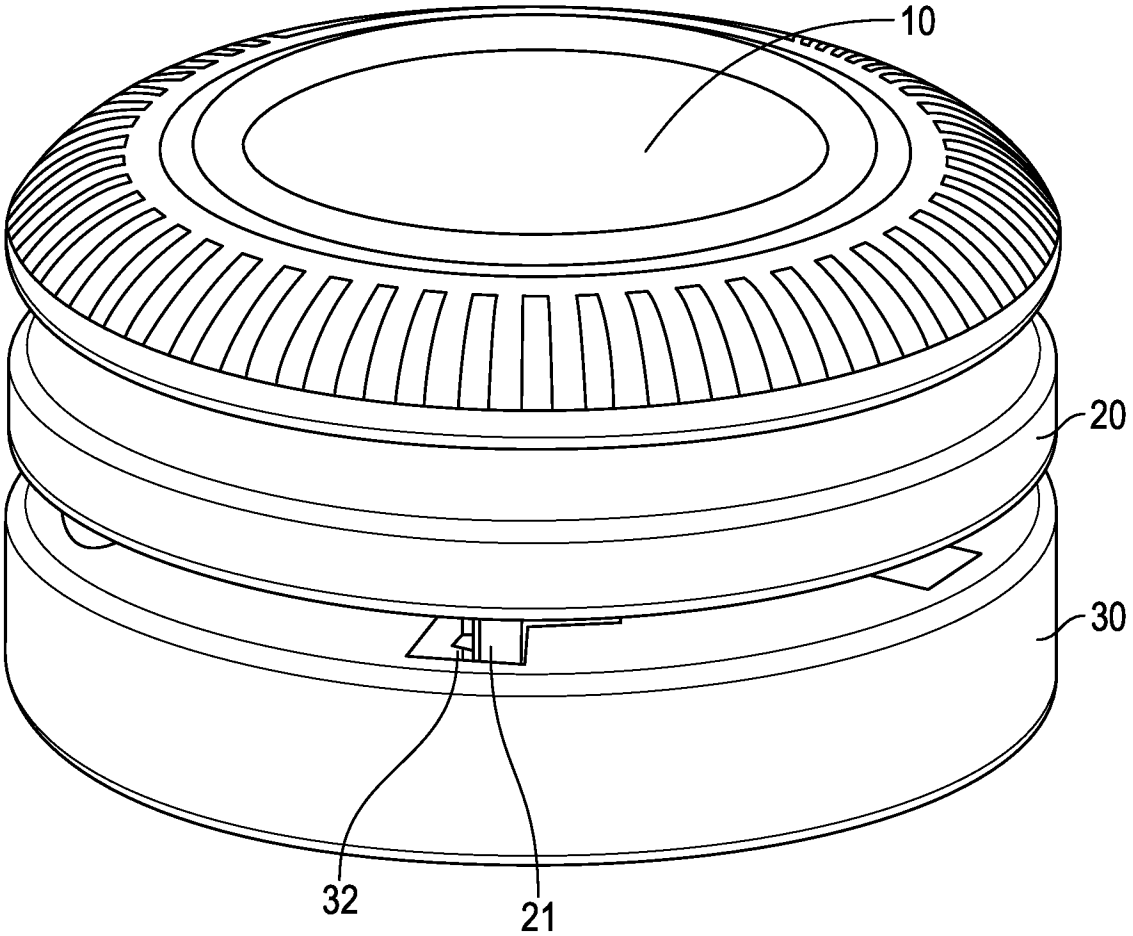
FIG. 4 is a front schematic view of the snap and lock button device closed design.

FIG. 4 is a front schematic view of the invention in the preferred embodiment with the closed design for plate 30, and incorporates the detailed description of FIG. 1.

Figure 5:
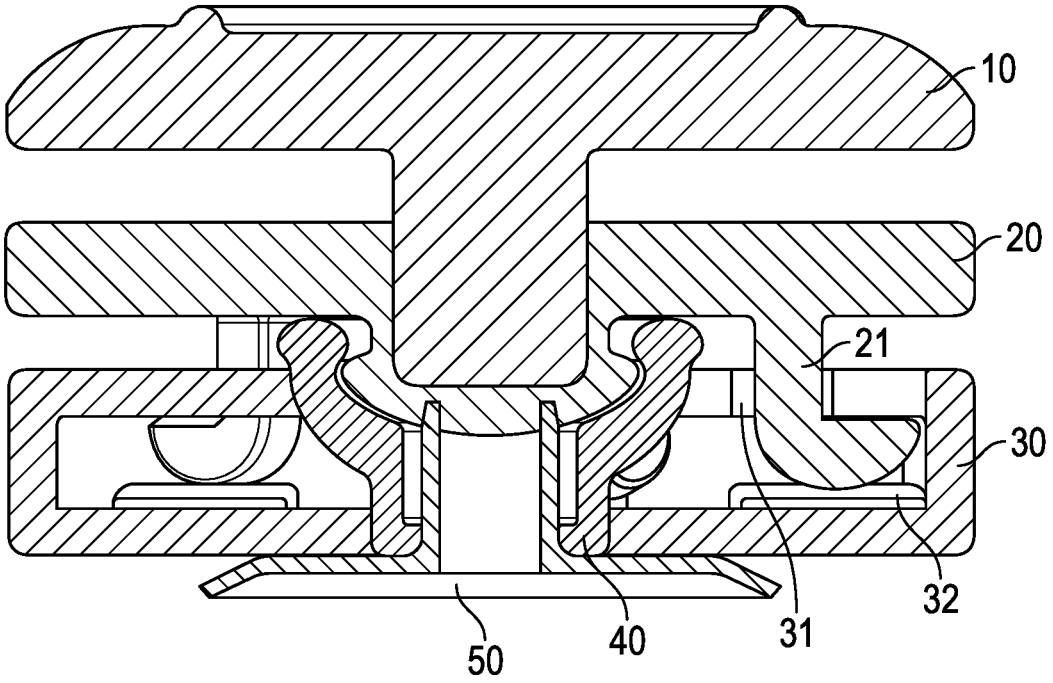
FIG. 5 is a cross-sectional view of the device shown in FIG. 4. taken from the center of the device.

FIG. 5 shows the cross-sectional view of the invention taken from the center of the invention with the closed design for plate 30, and incorporates the detailed description of FIG. 2 above.

Figure 6A:
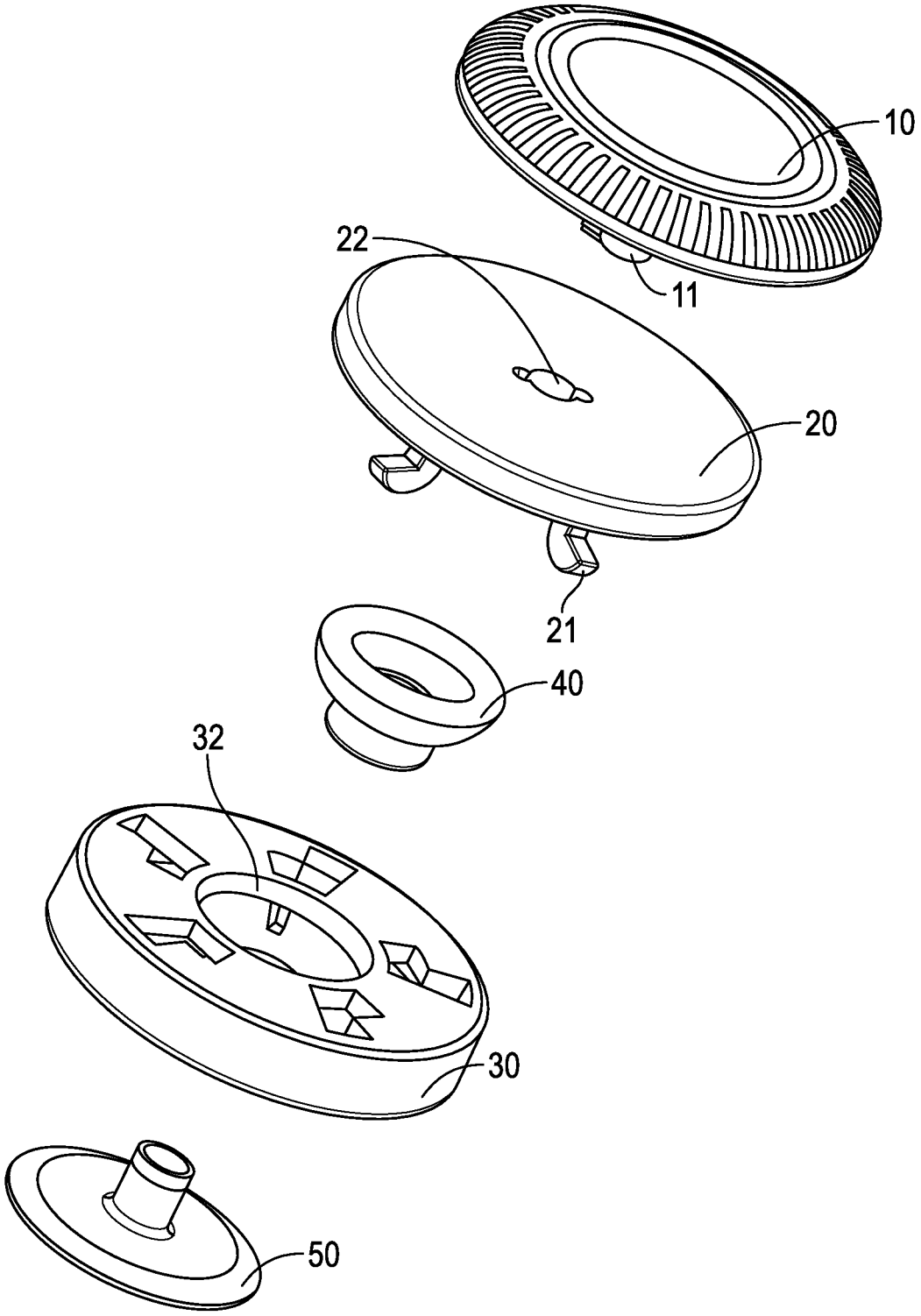
FIG. 6A is a semi-exploded angled view of the device shown in FIG. 4.

FIG. 6A is a semi-exploded view of the invention with the closed design for plate 30, and incorporates the detailed description of FIG. 3A above.

Figure 6B:
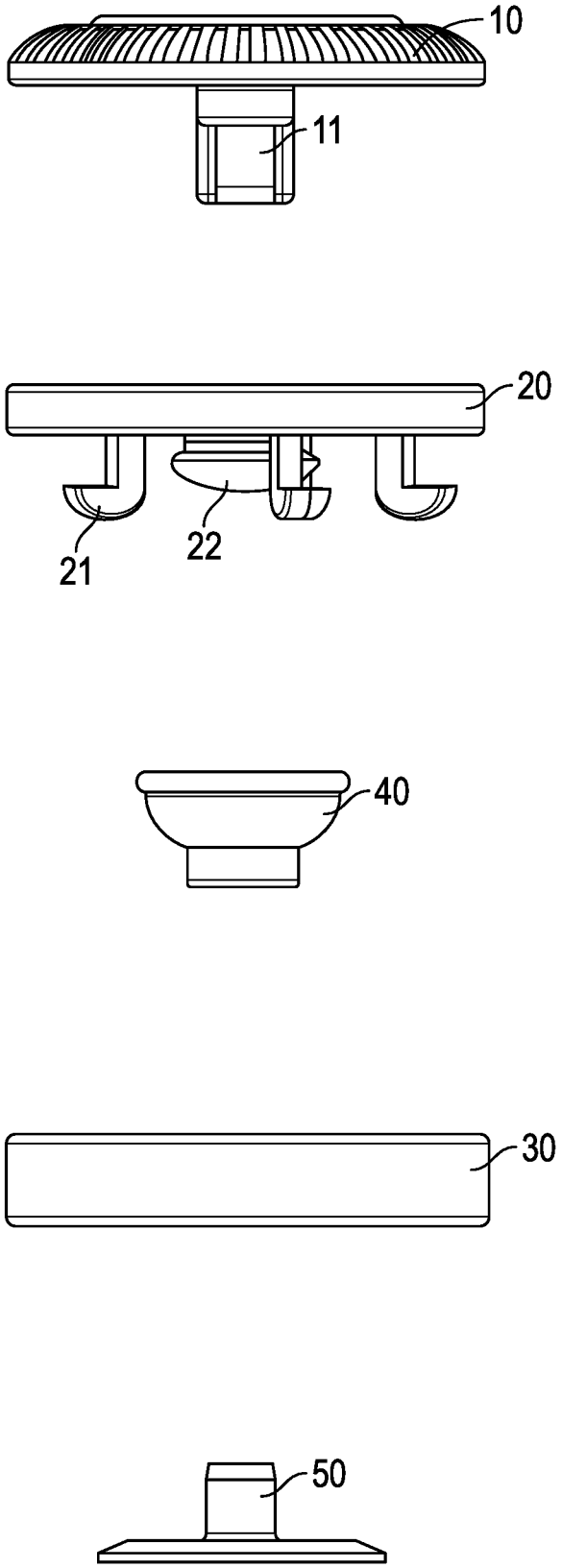
FIG. 6B is a semi-exploded front view of the device shown in FIG. 4.

FIG. 6B is a semi-exploded front view of the invention with the closed design for plate 30, and incorporates the detailed description of FIG. 3B above.

Figure 6C:
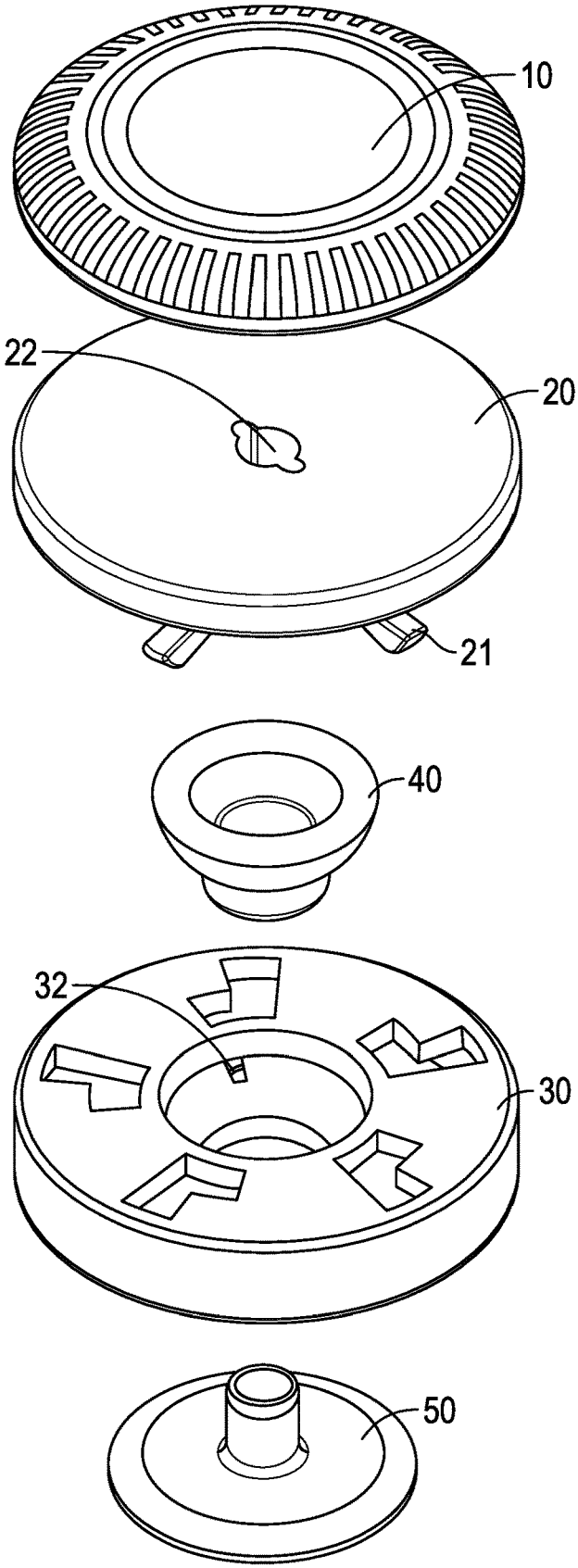
FIG. 6C is a semi-exploded front-angled view of the device shown in FIG. 4.

FIG. 6C is a semi-exploded front-angled view of the invention with the closed design for plate 30, and incorporates the detailed description of FIG. 3C above.

Figure 7:
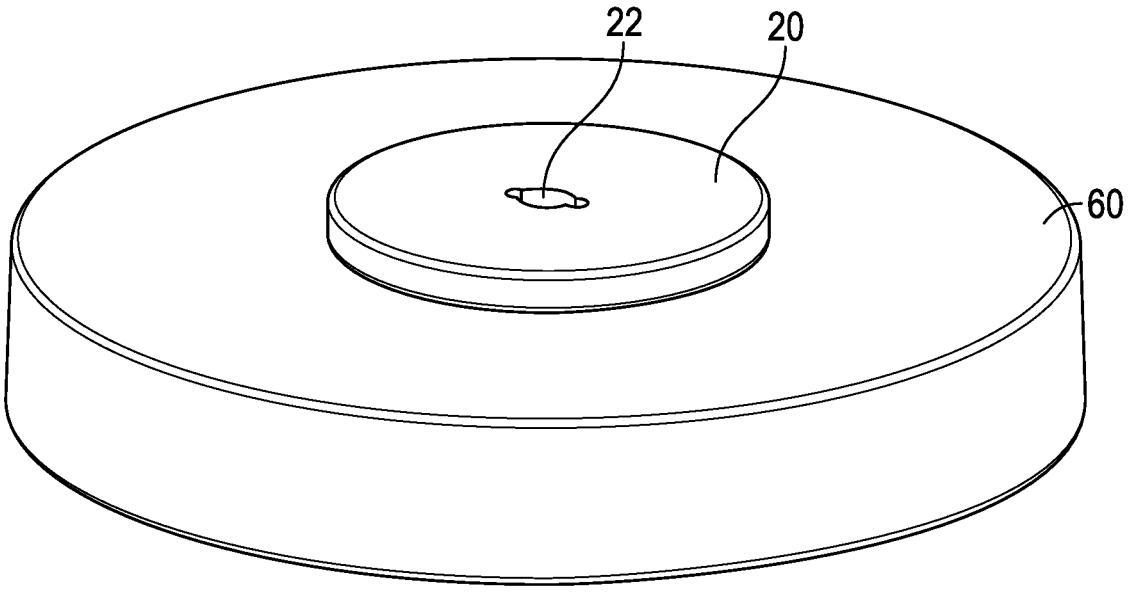
FIG. 7 is a front schematic view of the snap and lock button installation device.

FIG. 7 is a front-angled view of the plate 20 enclosed in installation device 60, said installation device holds the invention in place and guides installation and assembly of the invention.

Figure 8:
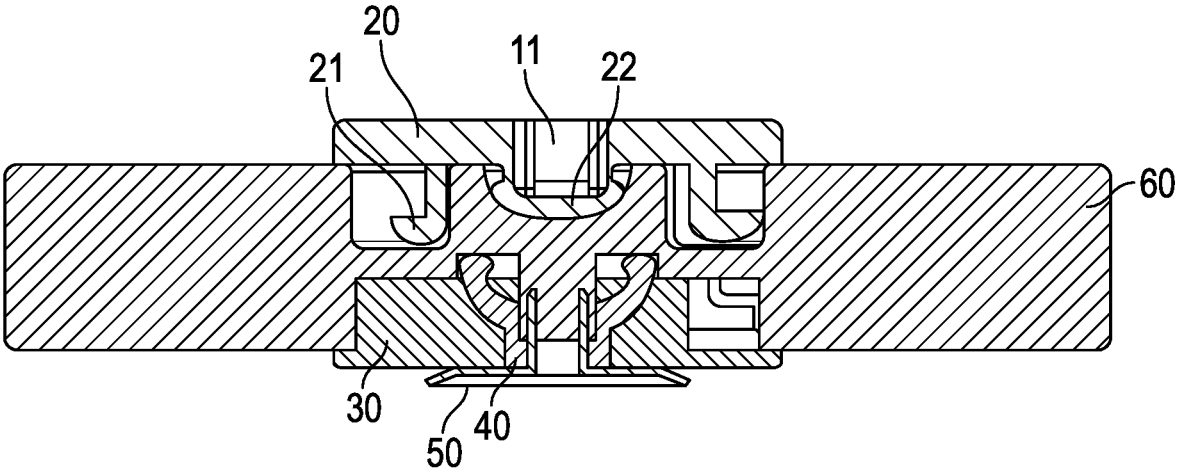
FIG. 8 is a cross-sectional view of the device shown in FIG. 7. taken from the center of the device with the open design.

FIG. 8 shows the cross-sectional view of the installation device 60 operating on the invention taken from the center of said device. In this FIG. 8, plate 30 is in the open design. The detailed description of FIG. 2 above is incorporated herein this FIG. 8.

Figure 9:
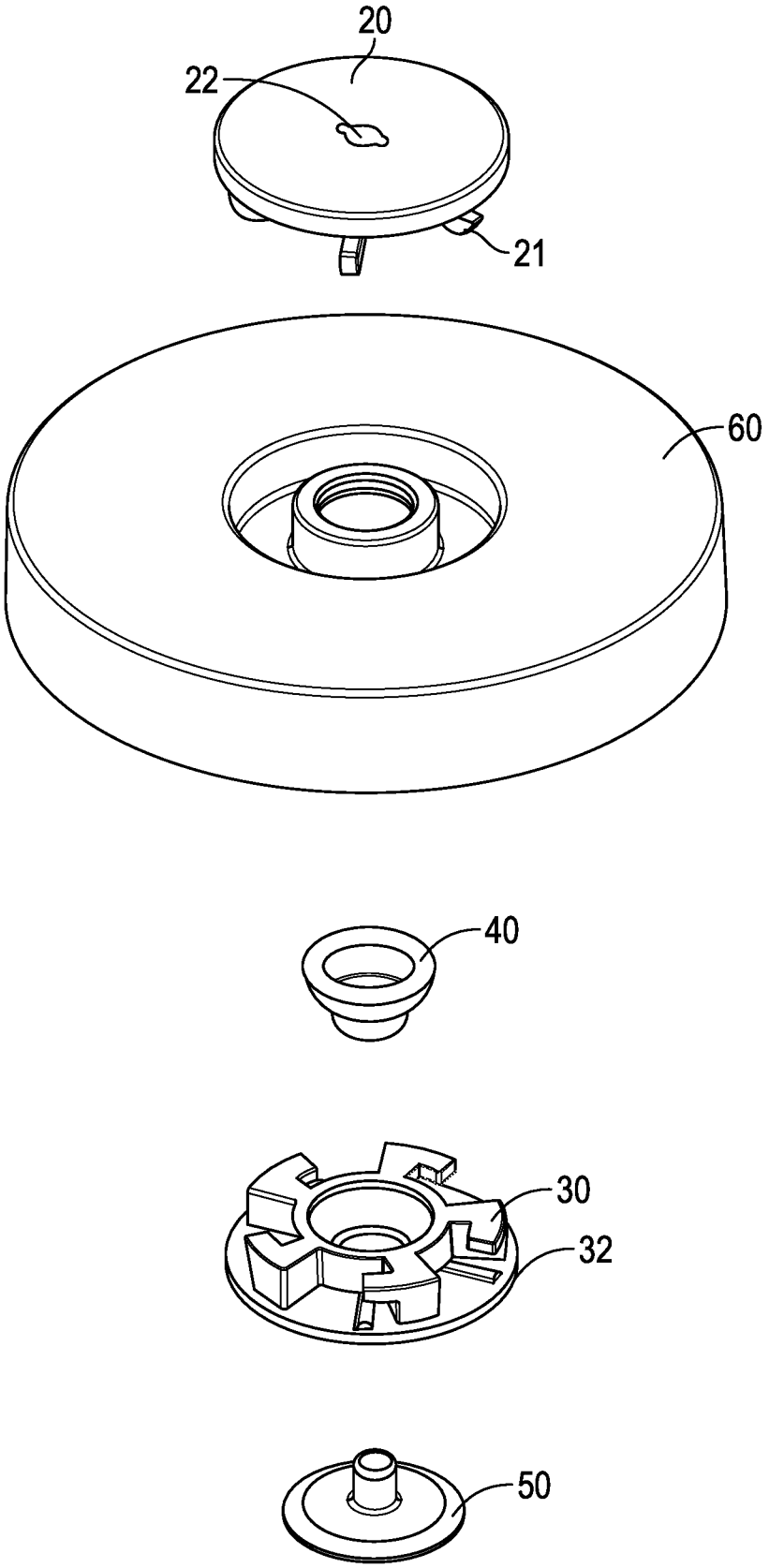
FIG. 9 is a semi-exploded front-angled view of the device shown in FIG. 7 with the open design.

FIG. 9 is a semi-exploded front-angled view of the installation device 60 operating on the invention while incorporating the detailed description of FIG. 3A above. In this FIG. 9, plate 30 is in the open design. Plate 10 is not shown in this FIG. 9.

Figure 10:
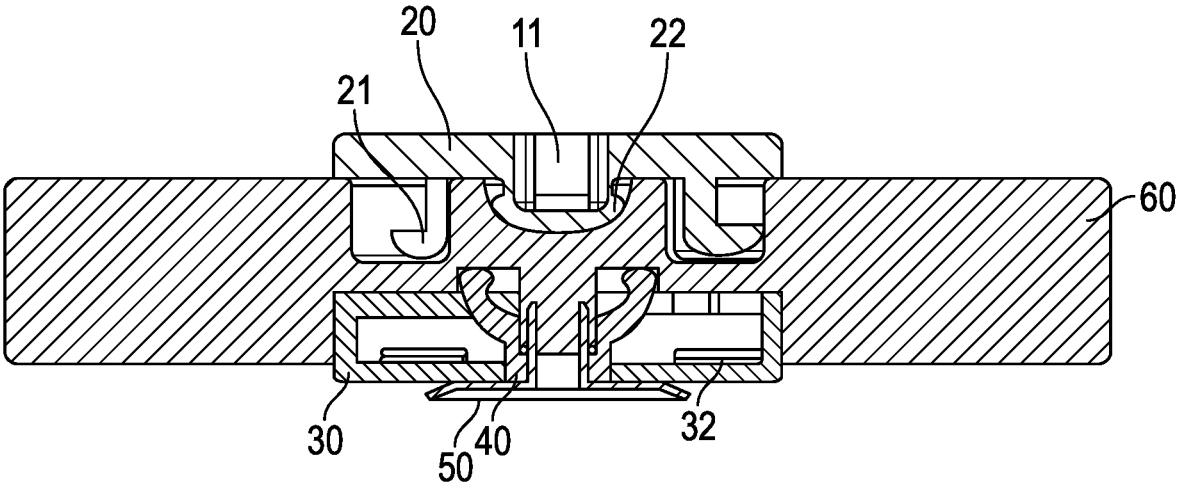
FIG. 10 is a cross-sectional view of the device shown in FIG. 7. taken from the center of the device with the closed design.

FIG. 10 shows the cross-sectional view of the installation device 60 operating on the invention taken from the center of said device. In this FIG. 10, plate 30 is in the closed design. The detailed description of FIG. 2 above is incorporated herein this FIG. 10.

Figure 11:
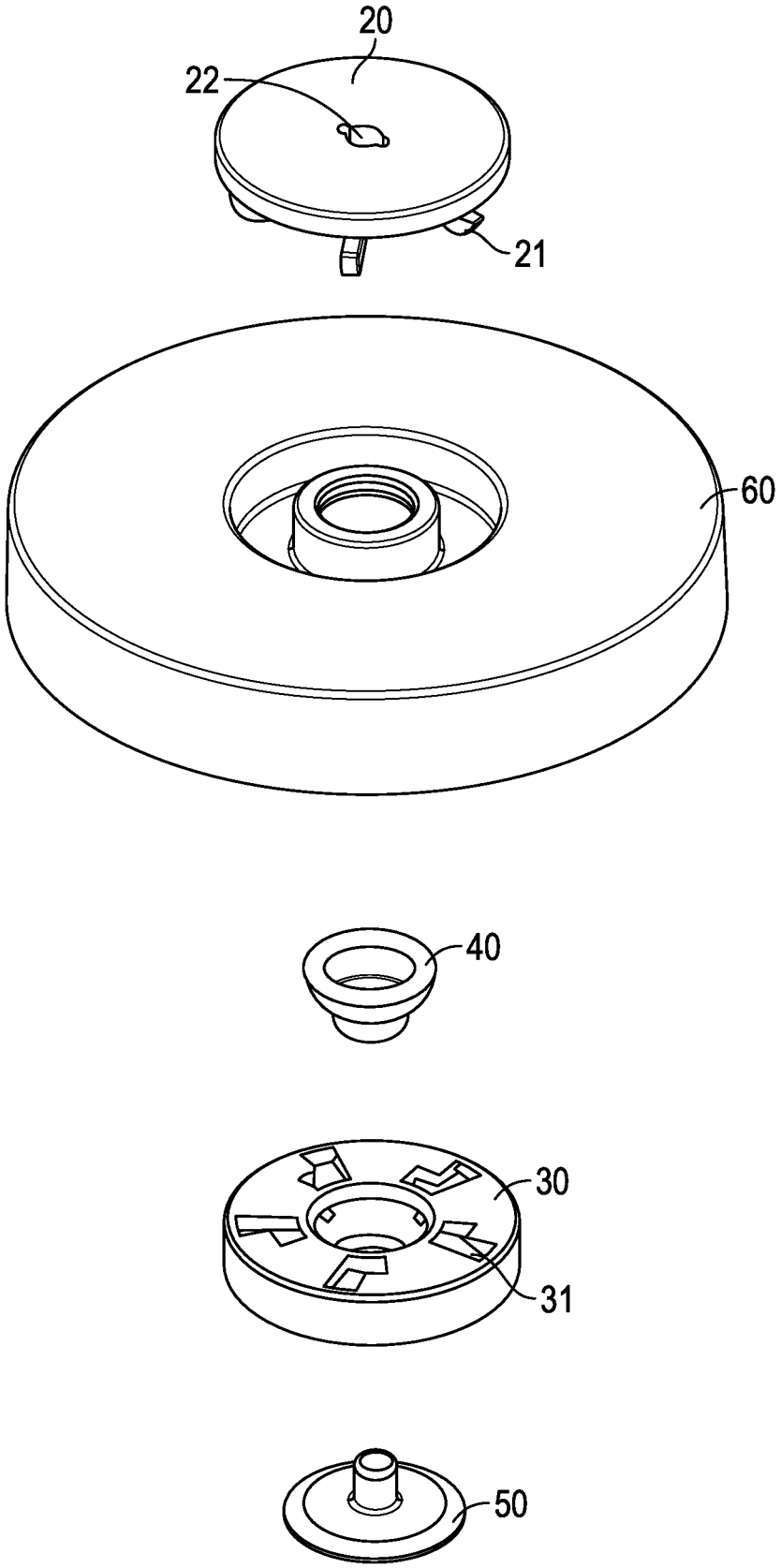
FIG. 11 is a semi-exploded front-angled view of the device shown in FIG. 7 with the closed design.

FIG. 11 is a semi-exploded front-angled view of the installation device 60 operating on the invention while incorporating the detailed description of FIG. 3A above. In this FIG. 11, plate 30 is in the closed design. Plate 10 is not shown in this FIG. 11.

What is claimed is:

1. A fastener system, said fastener system comprising:

a top member, the top member comprising a first surface and a second surface, the top member comprising a plurality of hinges disposed on the second surface; and a bottom member, the bottom member comprising a plurality of cavities, the plurality of cavities comprising an unlocked portion and a locked portion, the plurality of cavities configured to receive the plurality of hinges at the unlocked portion, wherein the locked portion of each of the plurality of cavities comprises a space to permit the plurality of hinges a degree of rotation into a locked position at the locked portion upon rotation of at least one of the top member and the bottom member.

2. The fastener system of claim 1, wherein the plurality of hinges comprises an L-shape.

3. The fastener system of claim 1, wherein the plurality of hinges is disposed radially from a center of the top member.

4. The fastener system of claim 1, wherein each of the plurality of cavities comprises an intermediary component disposed between the locked portion and the unlocked portion, the intermediary components of the plurality of cavities configured to keep the plurality of hinges in the locked position.

5. The fastener system of claim 4, wherein the intermediary components are configured to guide the plurality of hinges into the unlocked portion.

6. The fastener system of claim 5, wherein each of the intermediary components is configured to allow one of the plurality of hinges to rotate over the intermediary component upon rotation of at least one of the top member and the bottom member in a first rotation direction, each of the intermediary components further configured to hold one of the plurality of hinges into a locked position by resisting the at least one of the top member and the bottom member from rotating in a second rotation direction, the second rotation direction being opposite the first rotation direction.

7. The fastener system of claim 5, wherein each of the locked portions of the plurality of cavities further comprises a sidewall stop such that each of the plurality of hinges is disposed between the intermediary component and the sidewall stop of a respective cavity while in the locked position.

8. The fastener system of claim 1, each of the plurality of hinges further comprising a top section, a bottom section, a first side section, and a second side section, wherein each of the plurality of cavities is configured to apply a force to each of the top section, the bottom section, the first side section, and the second side section while in the locked position.

9. The fastener system of claim 8, wherein the locked portion in each of the plurality of cavities is formed by a sidewall stop, an intermediary component, an overhang component, and a cavity inner surface such that the sidewall stop abuts the first side section, the intermediary component abuts the second side section, the overhang components abuts the top section, and the cavity inner surface abuts the bottom section while in the locked position.

10. The fastener system of claim 1, wherein the locked portion in each of the plurality of cavities is formed by a sidewall stop, an intermediary component, an overhang component, and a cavity inner surface.

11. The fastener system of claim 1, the top member further comprising a perimeter wherein at least a portion of the plurality of hinges extends outwardly from the perimeter.

12. The fastener system of claim 11, wherein the perimeter comprises a circular shape.

13. The fastener system of claim 11, wherein the plurality of hinges is spaced evenly around the perimeter.

14. The fastener system of claim 1, wherein the plurality of cavities is spaced evenly from a center of the bottom member.

15. The fastener system of claim 1, wherein the top member is configured to concentrically couple to the bottom member.

16. The fastener system of claim 1, wherein the top member and the bottom member detachably couple by rotation of at least one of the top member and the bottom member.

17. A fastener system comprising:

a top member having a circular perimeter, the top member comprising a plurality of hinges wherein at least a portion of each of the plurality of hinges extends outwardly from the circular perimeter, the plurality of hinges being spaced evenly around the circular perimeter; and a bottom member configured to concentrically couple to the top member, the bottom member comprising a plurality of cavities spaced evenly about a center of the bottom member, the plurality of cavities configured to receive the plurality of hinges such that the plurality of hinges is configured to rotate a degree of rotation within the plurality of cavities into a locked position, wherein each of the plurality of cavities comprises:

an unlocked portion configured to receive one of the plurality of hinges, a locked portion configured to hold one of the plurality of hinges in the locked state, the locked portion comprising a space to permit one of the plurality of hinges a degree of rotation into the locked position at the locked portion upon rotation of at least one of the top member and the bottom member, an intermediary component disposed between the locked portion and the unlocked portion, the intermediary component configured to maintain the plurality of hinges in the locked position, wherein the intermediary component is configured to allow one of the plurality of hinges to rotate over the intermediary component upon rotation of at least one of the top member and the bottom member in a first rotation direction, the intermediary component further configured to maintain one of the plurality of hinges into the locked position by resisting the at least one of the top member and the bottom member from rotating in a second rotation direction, the second rotation direction being opposite the first rotation direction, a sidewall stop partially forming the locked portion, the sidewall stop being configured to abut one of the plurality of hinges while in the locked position such that each of the plurality of hinges is disposed between the intermediary component and the sidewall stop of a respective cavity while in the locked position, and an overhang component partially forming the locked portion, the overhang component configured to abut one of the plurality of hinges while in the locked position;

wherein the top member and the bottom member detachably couple by rotation of at least one of the top member and the bottom member.

* * * * *